US010457044B2

(12) United States Patent
Kato et al.

(10) Patent No.: US 10,457,044 B2
(45) Date of Patent: Oct. 29, 2019

(54) LIQUID DISCHARGE HEAD AND LIQUID DISCHARGE HEAD MANUFACTURING METHOD

(71) Applicant: CANON KABUSHIKI KAISHA, Tokyo (JP)

(72) Inventors: Masataka Kato, Hiratsuka (JP); Tomohiro Takahashi, Yokohama (JP); Shimpei Otaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 15/476,381

(22) Filed: Mar. 31, 2017

(65) Prior Publication Data

US 2017/0282554 A1 Oct. 5, 2017

(30) Foreign Application Priority Data

Apr. 5, 2016 (JP) ..... 2016-075686

(51) Int. Cl.
*B41J 2/14* (2006.01)
*B41J 2/16* (2006.01)

(52) U.S. Cl.
CPC ..... *B41J 2/1404* (2013.01); *B41J 2/14145* (2013.01); *B41J 2/1603* (2013.01); *B41J 2/1628* (2013.01); *B41J 2/1631* (2013.01); *B41J 2/1645* (2013.01)

(58) Field of Classification Search
CPC .... B41J 2/1404; B41J 2/1645; B41J 2/14145; B41J 2/1628; B41J 2/1603; B41J 2/1631; B41J 2/1606
See application file for complete search history.

(56) References Cited

U.S. PATENT DOCUMENTS

2011/0279550 A1 11/2011 Otaka

FOREIGN PATENT DOCUMENTS

| | | | |
|---|---|---|---|
| CN | 101001754 | A | 7/2007 |
| CN | 101076449 | A | 11/2007 |
| JP | 2006-198937 | A | 8/2006 |

*Primary Examiner* — Kristal Feggins
(74) *Attorney, Agent, or Firm* — Canon U.S.A., Inc. I.P. Division

(57) ABSTRACT

A liquid discharge head includes a plurality of recording element substrates each having an energy generating element configured to generate energy for discharging liquid from a discharge port, and a sealing member with which a surround of each of the plurality of recording element substrates is filled. Each of the plurality of recording element substrates includes a recessed portion formed on an end surface facing a neighboring recording element substrate, and in the recessed portion, a gap between neighboring recording element substrates is wider than a gap between element surfaces on which the energy generating element is provided.

10 Claims, 8 Drawing Sheets

LIQUID DISCHARGE HEAD AND LIQUID DISCHARGE HEAD MANUFACTURING METHOD

BACKGROUND OF THE INVENTION

Field of the Invention

The present disclosure relates to a liquid discharge head and a liquid discharge head manufacturing method.

Description of the Related Art

A liquid discharge head that discharges liquid from a discharge port with energy generated by an energy generating element can be configured to include a plurality of aligned recording element substrates having the energy generating element(s). For example, a conventional liquid discharge head is discussed in Japanese Patent Application Laid-Open No. 2006-198937. The discussed liquid discharge head includes a silicon substrate serving as a supporting member and a sealing member with which the surround of each recording element substrate filled to prevent the silicon substrate from being eroded with ink.

FIGS. 8A, 8B, and 8C each illustrate an exemplary configuration of a liquid discharge head including the above-mentioned sealing member. FIG. 8A is a plan view illustrating the liquid discharge head. FIG. 8B is a cross-sectional view taken along a line C-C of FIG. 8A. FIG. 8C is a cross-sectional view taken along a line D-D of FIG. 8A.

The liquid discharge head includes a plurality of recording element substrates 900. Each recording element substrate 900 includes a plurality of discharge ports 901 provided thereon. The liquid discharge head includes an electrical wiring substrate 902 provided around the recording element substrates 900. Intervening spaces extending between respective recording element substrates 900 are filled with a sealing member 903. Similarly, a boundary space between the electrical wiring substrate 902 and the recording element substrates 900 is filled with the sealing member 903. Each recording element substrate 900 is connected with the electrical wiring substrate 902 via lead lines 904. The recording element substrates 900 and the electrical wiring substrate 902 are provided on a support member 905.

For example, thermosetting liquid is usable to form the sealing member 903 in this case, the sealing member 903 is injected with a needle and hardened with heat, so that the sealing member 903 is applied on the support member 905.

SUMMARY OF THE INVENTION

A liquid discharge head according to an aspect of the present disclosure includes a plurality of recording element substrates each having an energy generating element configured to generate energy required to discharge liquid from a discharge port, and a sealing member with which a surround of each of the plurality of recording element substrate is filled. Each recording element substrate includes a recessed portion on an end surface that faces a neighboring recording element substrate, and in the recessed portion, a gap between neighboring recording element substrates is wider than a gap between element surfaces on which the energy generating element is provided.

Further, a liquid discharge head manufacturing method according to an aspect of the present disclosure is a method for manufacturing a liquid discharge head provided with a plurality of recording element substrates each having an energy generating element configured to generate energy for discharging liquid from a discharge port. The manufacturing method includes dicing, as a first dicing, for forming a groove on a substrate and dicing, as a second dicing, for separating the substrate in the groove formed through the first dicing, with a width narrower than the groove, to form the recording element substrate.

Further, a liquid discharge head according an aspect of the present disclosure includes a plurality of recording element substrates having an energy generating element configured to generate energy for discharging liquid from a discharge port, and a sealing member with which a surround of each of the plurality of recording element substrates is filled. A gap, between neighboring recording element substrates, on a back surface of an element surface on which the energy generating element is provided is wider than a gap, between the neighboring recording element substrates, on the element surface.

Further features of the present disclosure will become apparent from the following description of exemplary embodiments with reference to the attached drawings.

BRIEF DESCRIPTION OF THE DRAWINGS

FIGS. 4A, 4B, 4C-1, 4C-2, 4D, 4E-1, and 4E-2 illustrate manufacturing processes of the liquid discharge head illustrated in FIGS. 3A and 3B.

FIGS. 6A-6E, 6F-1, and 6F-2 illustrate manufacturing processes of the liquid discharge head illustrated in FIGS. 5A and 5B FIGS. 7A-1, 7A-2, 7B-1, 7B-2, 7C-1, 7C-2, 7D-1, and 7D-2 illustrate the configurations of liquid discharge heads according to forth to sixth exemplary embodiments of the present disclosure.

DESCRIPTION OF THE EMBODIMENTS

Figure 1A:
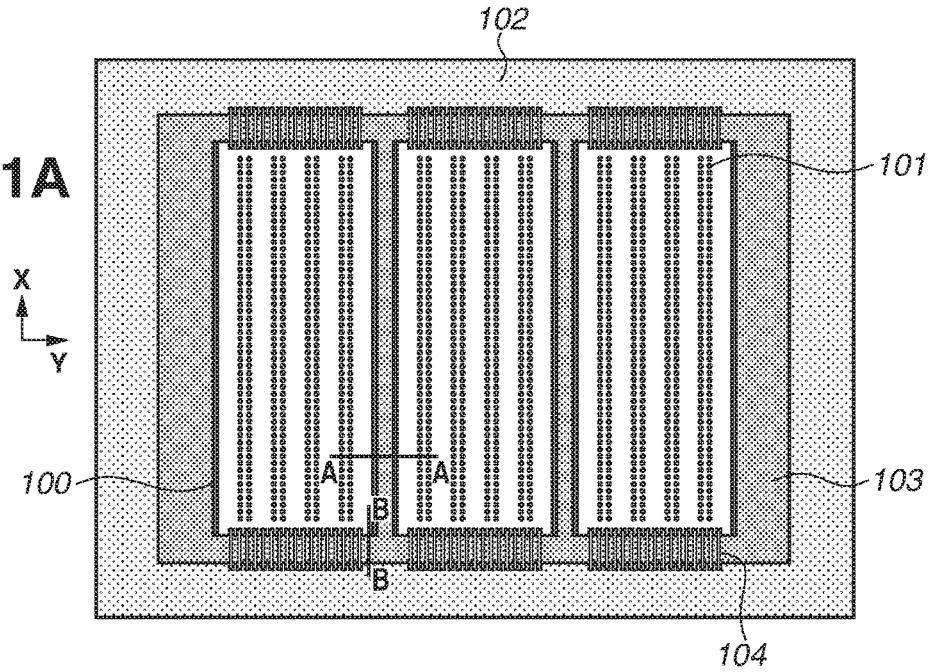
FIGS. 1A, 1B, and 1C illustrate the configuration of a liquid discharge head according to a first exemplary embodiment of the present disclosure.

According to the liquid discharge head discussed in Japanese Patent Application Laid-Open No. 2006-198937, it is difficult to fill intervening spaces extending between neighboring recording element substrates with a sealing member. As discussed in Japanese Patent Application Laid-Open No. 2006-198937, a manufacturing process includes inserting the needle into the boundary space extending along the internal edge of the electrical wiring substrate in such a way as to surround the recording element substrates and then injecting the sealing member with the needle. From the viewpoint of downsizing and cost reduction, it is desired to arrange the plurality of recording element substrates closely as much as possible. To that end, a flow resistance tends to become higher in the intervening spaces extending between respective recording element substrates, so that it is difficult to cause the sealing member to smoothly flow into the intervening spaces. In particular, if the flow resistance in the intervening spaces between respective recording element substrates is higher than the flow resistance in the boundary space extending along the internal edge of the electrical wiring substrate in such a way as to surround the recording element substrates, the sealing member first flows into the boundary space between the electrical wiring substrate and the recording element substrates. Accordingly, causing the sealing member to appropriately flow into the intervening spaces between respective recording element substrates is difficult.

Accordingly, the present disclosure intends to provide a liquid discharge head including a plurality of aligned recording element substrates, which can easily fill the intervening spaces extending between respective recording element substrates with a sealing member even in a case where the distance between neighboring recording element substrates shorter.

Hereinafter, exemplary embodiments of the present disclosure will be described in detail below with reference to accompanied drawings. In the following description and drawings, constituent components are denoted by using the same reference numerals if their functions are similar to each other and redundant description thereof will be avoided.

(Configuration of Liquid Discharge Head)

Figure 1B:
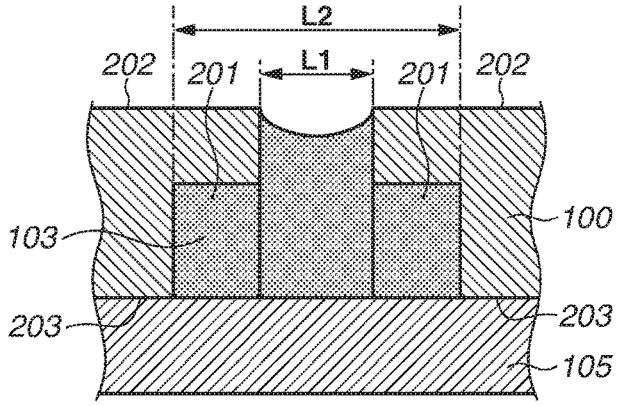
Figure 1C:
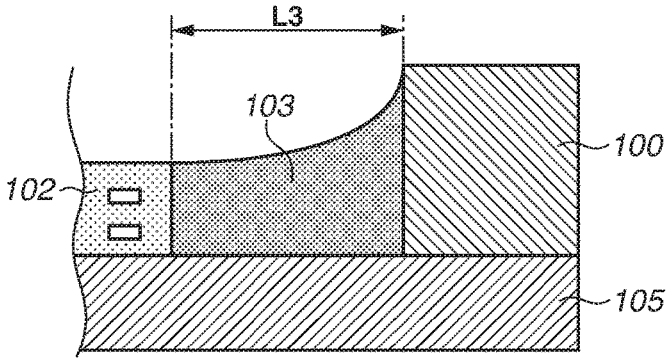

A first exemplary embodiment of the present disclosure will be described in detail below. FIGS. 1A, 1B, and 1C each illustrate the configuration of a liquid discharge head according to the present exemplary embodiment. FIG. 1A is a plan view illustrating a surface of the liquid discharge head on which a plurality of recording element substrates is disposed, which is seen from a liquid discharge direction. FIG. 1B is a cross-sectional view taken along a line A-A of FIG. 1A. FIG. 10 is a cross-sectional view taken along a line B-B of FIG. 1A.

The liquid discharge head illustrated in FIGS. 1A, 1B and 1C includes a plurality of recording element substrates 100, an electrical wiring substrate 102, and a support member 105. The recording element substrates 100 and the electrical wiring substrate 102 are disposed on the support member 105 to which the recording element substrates 100 and the electrical wiring substrate 102 are bonded with, for example, an appropriate adhesive agent. The plurality of recording element substrates 100 is aligned in a central region of the support member 105. The electrical wiring substrate 102 is provided in an outer peripheral region of the support member 105 in such a way as to surround the plurality of recording element substrates 100. The plurality of recording element substrates 100 aligns in a direction Y intersecting (more specifically, "orthogonal to" according to the illustrated example) with a direction X in which each discharge port 101 aligns.

Although not illustrated in FIGS. 1A, 1B, and 1C, each recording element substrate 100 includes, for example, a silicon substrate and a resin substrate on which the plurality of discharge ports 101 is formed. An energy generating element configured to generate energy required to discharge liquid from each discharge port 101 is provided on the silicon substrate, at a position facing the discharge port 101. Each recording element substrate 100 is rectangular. Contacts which electrically connect the recording element substrate 100 to the electrical wiring substrate 102, are provided along two parallel sides of the rectangle. Each recording element substrate 100 is electrically connected to the electrical wiring substrate 102 via a lead wiring 104. The electrical wiring substrate 102 is electrically connected to a liquid discharge apparatus body (not illustrated).

The surround of each recording element substrate 100, for example, each intervening space extending between neighboring recording element substrates 100 and the rectangular boundary space extending along the internal edge of the electrical wiring substrate 102 in such a way as to surround the recording element substrates 100 are filled with a sealing member 103. A thermosetting resin composition, such as a thermosetting epoxy resin composition, is desirably used for the sealing member 103.

A gap L1 is present between adjacent element surfaces 202 on which the energy generating elements of the recording element substrate 100 are provided. A gap L3 is present between the electrical wiring substrate 102 and the recording element substrates 100. The gap L1 is narrower than the gap L3. Accordingly, to smoothly enter the sealing member 103 into the intervening spaces extending between respective recording element substrates 100, a recessed portion 201 is provided on an end surface of the recording element substrate 100, which faces an end surface of another recording element substrate 100. A gap L2 is present between neighboring recording element substrates 100 at the recessed portion 201. The gap L2 is wider than the gap L1, which is present between adjacent element surfaces 202. No recessed portion is provided on an end surface, of the recording element substrate 100, which does not face another recording element substrate 100.

In the example illustrated in FIGS. 1A, 1B, and 1C, the recessed portion 201 is communicated with another end surface that intersects with the end surface on which the recessed portion 201 is provided. Accordingly, the recessed portion 201 is opened to the other end surface. Thus, it becomes feasible to cause the sealing member 103 to flow into the intervening space between the recording element substrates 100, including the recessed portions 201, from the other end surface side. The recessed portion 201 is communicated with a back surface 203. In the state where the recessed portion 201 communicated with the back surface 203, the recessed portion 201 can be formed by dicing of the recording element substrate 100 from the back surface 203 as described in detail below. The recessed portion 201 can be formed into any other shape if the sealing member 103 can smoothly flow into the intervening spaces extending between respective recording element substrates 100. For example, the recessed portion 201 has level difference shape as illustrated in FIG. 1B. According to the illustrated configuration, the distance between neighboring recording element substrates 100 is wider when it is measured along a surface connecting the back surfaces 203 than when it is measured along a surface connecting the element surfaces 202. In other words, it is feasible to widen the intervening spaces extending between neighboring recording element substrates 100 while a narrow gap between neighboring element surfaces 202 on which the energy generating elements are provided is maintained. Accordingly, it is feasible to easily fill the intervening gaps between respective recording element substrates 100 with the sealing member 103, while a higher density in aligning the energy generating elements is maintained.

An exemplary method for filling narrow intervening spaces between respective recording element substrates 100 with the sealing member 103 includes inserting of a needle into the spaces between the recording element substrates 100. However, in the use of the needle, a thinner needle is required as the intervening spaces extending between respective recording element substrates 100 are narrower. If the needle is thin, an injection amount of the sealing member 103 per unit time is smaller. Accordingly, the time required to charge the sealing member 103 is longer, resulting in an increase in the process tact. Furthermore, if the viscosity of the sealing member 103 is higher, injecting the sealing member 103 will be difficult, so that types of usable sealing members will be limited. In this respect, the configuration according to the present exemplary embodiment excludes the need to use a thin needle that can enter the narrow intervening spaces extending between respective recording element substrates. Therefore, it is feasible to solve the above-mentioned issues.

(Liquid Discharge Head Manufacturing Method)

FIGS. 2A, 2B, 2C-1, 2C-2, 2D, 2E-1, and 2E-2 illustrate an exemplary method for manufacturing the liquid discharge head illustrated in FIGS. 1A, 1B, and 1C.

Figure 2A:
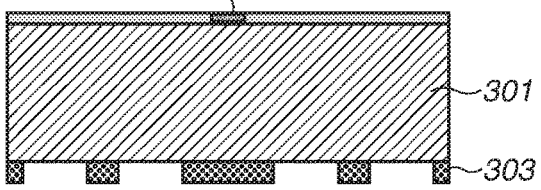
FIGS. 2A, 2B, 2C-1, 2C-2, 2D, 2E-1, and 2E-2 illustrate manufacturing processes of the liquid discharge head illustrated in FIGS. 1A to 1C.

The manufacturing method includes preparing a silicon substrate 301 having an element surface on which energy generating elements 302 are provided, as illustrated in FIG. 2A. The manufacturing method further includes forming a first etching mask layer 303 on a back surface of the silicon substrate 301 (i.e., the opposite surface from the element surface). It is desired that the first etching mask layer 303 is a silicon oxide film, a silicon nitride film, a silicon oxynitride film, or a photosensitive resin film. The first etching mask layer 303 functions as a mask for forming first liquid supply ports 304 and grooves 305 illustrated in FIG. 2B. Accordingly, the first etching mask layer 303 is patterned in such a way as to cover the entire back surface excluding specific portions where the first liquid supply ports 304 and the grooves 305 are to be formed.

Figure 2B:
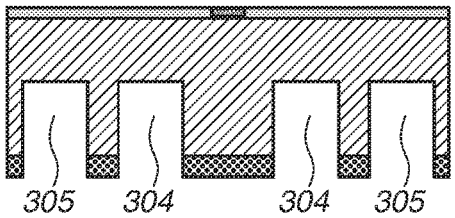

FIG. 2B illustrates an exemplary state of the silicon substrate 301 that has been subjected to reactive ion etching (hereinafter, referred to as "RIE") in the state where the first etching mask layer 303 is used as the mask. The above-mentioned etching process can be referred to as "first dicing process". The first liquid supply ports 304 and the grooves 305 can be formed simultaneously through the first dicing process.

In the present exemplary embodiment, the RIE is directional etching that uses ions. The RIE includes the process for cutting and processing a region to be etched by causing particles to collide with the substrate while supplying electric charges to the region to be etched. An apparatus configured to perform the RIE includes a plasma source capable of generating ions and a reaction chamber in which the etching is performed, which are provided separately. For example, in a case where the employed etching apparatus is an inductive coupling plasma (ICP) dry etching apparatus that can generate high-density ions for the plasma source, it is feasible to alternately perform coating processing and etching processing (i.e., deposition/etching processing). This configuration can form the first liquid supply ports 304 in such a way as to extend in a direction perpendicular to the substrate. For example, in the deposition/etching processing, an $SF_6$ gas can be used as an etching gas, and a $C_4F_8$ gas can be used as a coating gas. Fine lateral grooves (not illustrated), referred to as "scallops", can be formed on an etched sidewall by alternately repeating the coating processing and the etching processing, so that the sealing member can smoothly flow along the lateral grooves. Accordingly, use of the ICP plasma apparatus for dry etching in the first dicing process is desirable. However, another type of plasma source is usable. For example, an apparatus including an electron cyclotron resonance (ECR) plasma source is usable.

Figures 1, 2C:
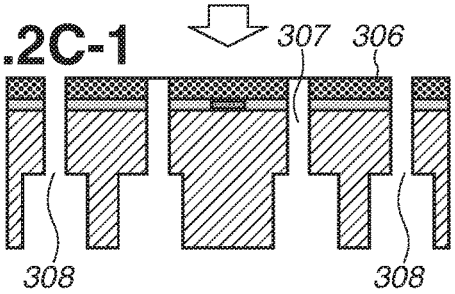
Figures 2, 2C:
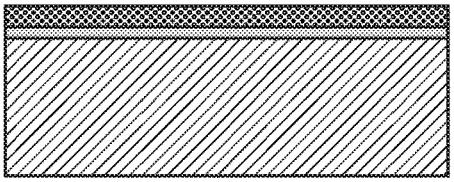

FIGS. 2C-1 and 2C-2 illustrate an exemplary state of the substrate that has been subjected to a second dicing process performed after completing the first dicing process. The second dicing process includes removing the first etching mask layer 303 and forming a second etching mask layer 306 on the element surface of the silicon substrate 301. The second etching mask layer 306 functions as a mask for forming second liquid supply ports 307 and disconnection portions 308. Each of the second liquid supply ports 307 is communicated with a corresponding first liquid supply port 304. Each disconnection portion 308 separates, in corresponding groove 305, the silicon substrate 301 with a width narrower than that of the groove 305. Thus, the second etching mask layer 306 are patterned in such a way as to cover the entire element surface excluding specific portions where the second liquid supply ports 307 and the disconnection portions 308 are to be formed. FIG. 20-2 illustrates an end surface region where forming the level difference is unnecessary. In this region, the silicon substrate 301 is not separated with the disconnection portion 308 at the same time as formation of the second liquid supply port 307. For example, the manufacturing method employs the RIE in the second dicing process to form the second liquid supply ports 307 and the disconnection portions 308.

Figure 2D:
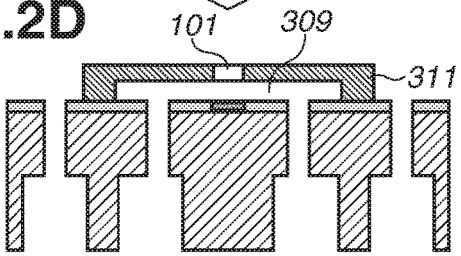

FIG. 2D illustrates an exemplary state of the substrate in which the second etching mask layer 306 has been removed from the element surface after completing the second dicing process, and then a discharge port formation member 311 is newly formed on the element surface. The discharge port formation member 311 includes a liquid passage 309 and a liquid discharge port 101. The liquid discharge port 101 is provided at a position corresponding to a corresponding energy generating element 302.

Although not illustrated, a method using a support and a photosensitive resin is employable as a method for providing the discharge port formation member 311 on the element surface. Although examples of the support include a film, a glass, and a silicon wafer, the film will be desired to be employed in view of easiness in separating the support later. Examples of the film include a polyethylene terephthalate (hereinafter, referred to as "PET") film, a polyimide film, and a polyamide film. The manufacturing method can additionally include releasing processing that can facilitate the separation of the film.

A coating method represented by spin coating or slit coating, or a transfer method represented by lamination or pressing is an exemplary method for forming a first photosensitive resin layer on the support. The first photosensitive resin layer is formed with an appropriate thickness (e.g., 20 μm). Appropriate resin, such as epoxy resin, acrylic resin, or urethane resin, that can dissolve in an organic solvent is an example of the first photosensitive resin. The manufacturing method further includes forming a second photosensitive resin layer (not illustrated) after completing the patterning of the first photosensitive resin layer, forming the discharge ports 101 in the second photosensitive resin layer, and removing the first photosensitive resin layer with the organic solvent to form the liquid passage 309. Through such a procedure, the discharge port formation member 311 can be formed from the second photosensitive resin layer.

Figures 1, 2E:
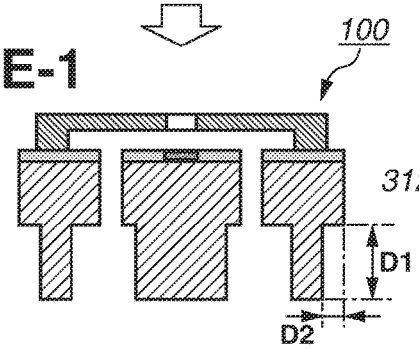
Figures 2, 2E:
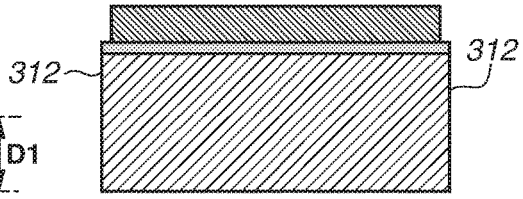

FIG. 2E-2 illustrates an end surface on which forming the recessed portion is unnecessary. The manufacturing method includes cutting the silicon substrate 301 through blade dicing performed on this region to form the recording element substrate. Through the process, the end portion of the recording element substrate can be configured into a blade dicing surface 312. A height D1 of the recessed portion illustrated in FIG. 2E-1 is, for example, in a range from 100 μm to 600 μm, desirably, in a range from 300 μm to 500 μm.

An eaves width D2 of the recessed portion is, for example, in a range from 10 μm to 200 μm, desirably, in a range from 20 μm to 100 μm. Through the above-mentioned process, the recording element substrate 100 can be formed from the silicon substrate 301. The manufacturing method includes bonding the obtained recording element substrates 100 to the support member 105 illustrated in FIGS. 1B and 1C and charging the sealing member 103 into the intervening spaces extending between respective recording element substrates 100 and the boundary space extending along the internal edge of the electrical wiring substrate 102 in such a way as to surround the recording element substrates 100. For example, the sealing member 103 can be injected from an end portion where the recessed portion 201 of the recording element substrate 100 is formed, located between the recording element substrates 100 and the electrical wiring substrate 102. The manufacturing method includes connecting respective recording element substrates 100 to the electrical wiring substrate 102 via the lead wiring 104.

Figure 3A:
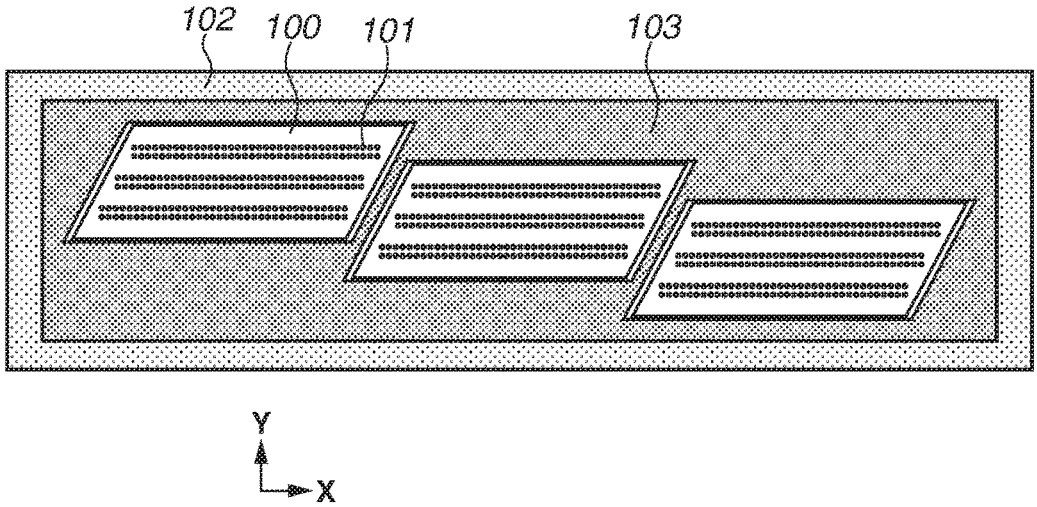
FIGS. 3A and 3B illustrate the configuration of a liquid discharge head according to a second exemplary embodiment of the present disclosure.
Figure 3B:
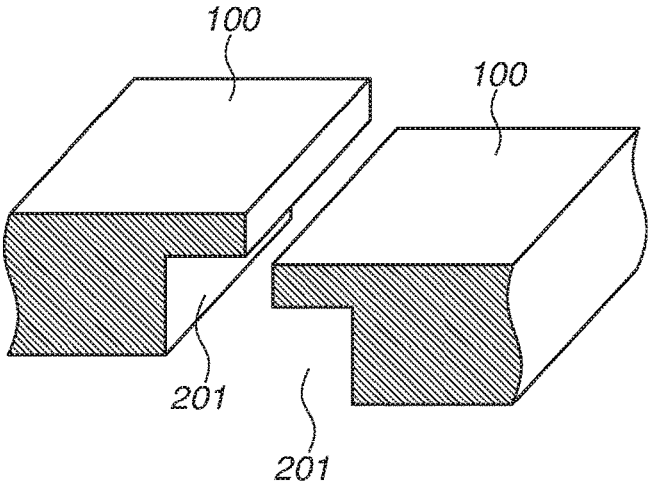
Figure 4A:
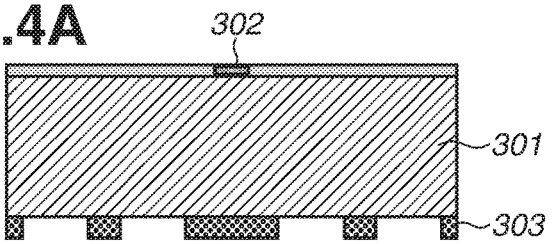
Figure 4B:
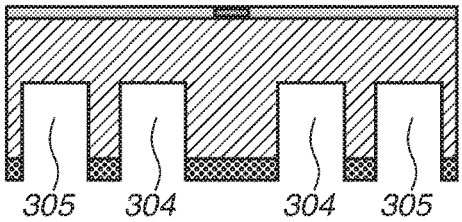
Figures 1, 4C:
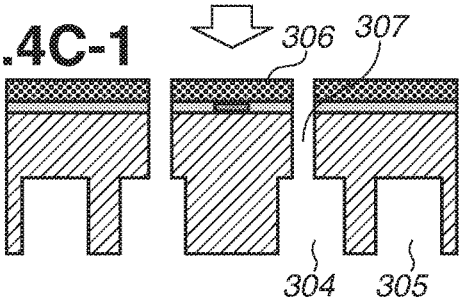
Figures 2, 4C:
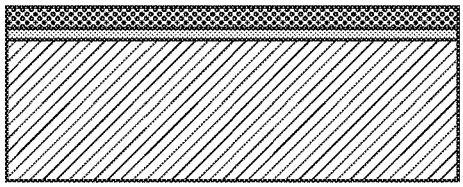
Figure 4D:
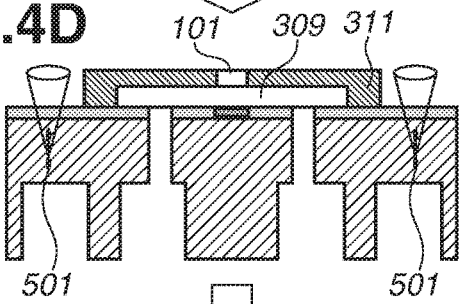
Figures 1, 4E:
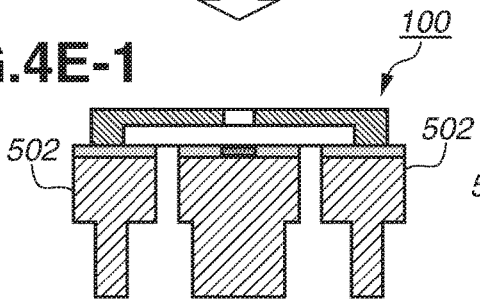
Figures 2, 4E:
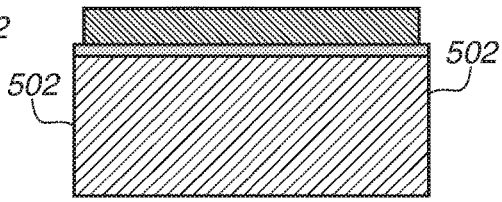

A second exemplary embodiment of the present disclosure will be described below. FIGS. 3A and 3B illustrate the configuration of a liquid discharge head according to the present exemplary embodiment. The liquid discharge head according to the present exemplary embodiment includes recording element substrates disposed in such a manner that discharge ports are formed in a range that can cover a maximum width of a recording medium to be possibly used. Accordingly, the liquid discharge head according to the present exemplary embodiment installable on a full-multi type liquid discharge apparatus that can perform recording in a relatively wider range without moving the liquid discharge head to perform scanning in the width direction. In the liquid discharge head installable on the full-multi type apparatus, the gap between neighboring recording element substrates influences the gap between discharge ports. Thus, it is necessary to dispose the recording element substrates adjacently to realize high-definition recording.

In the present exemplary embodiment, each recording element substrate 100 is a parallelogram. A plurality of recording element substrates 100 is disposed in central region of the supporting member (not illustrated) and aligned in the direction X. Each alignment of discharge ports 101 extends in the direction. X. Thus, an end surface in a direction intersecting with the direction X, along which the discharge ports 101 of the recording element substrates 100 are aligned is opposed to a neighboring recording element substrate 100. The gap between neighboring recording element substrates 100 approximately 30 μm. In the example, each recording element substrate 100 includes a pair of sides parallel to the direction X along which the discharge ports 101 are aligned and includes another pair of sides that are not orthogonal to the direction X. Accordingly, a side opposed to a neighboring recording element substrate 100 extends in an oblique (i.e., non-orthogonal) direction relative to the direction X along which the discharge ports 101 are aligned.

The shape of each recording element substrate 100 illustrated in FIGS. 3A and 3B is a mere example. For example, in a case where each recording element substrate 100 is rectangle (i.e., in a case where four angles of the parallelogram are equal to each other), it may be useful to dispose the recording element substrates 100 in a staggered pattern.

FIG. 3B illustrates an enlarged cross-sectional shape of two recording element substrates 100 illustrated in FIG. 3A at a portion where end surfaces thereof are positioned closely. In the present exemplary embodiment, the recording element substrate 100 includes the recessed portion 201 formed on an end surface that is opposed to a neighboring recording element substrate 100.

FIGS. 4A, 4B, 4C-1, 4C-2, 4D, 4E-1, and 4E-2 illustrate an exemplary method for manufacturing the liquid discharge head illustrated in FIGS. 3A and 3B. The method illustrated in FIGS. 4A, 4B, 4C-1, 4C-2, 4D, 4E-1, and 4E-2 is different from the method according to the first exemplary embodiment illustrated in FIGS. 2A, 2B, 2C-1, 2C-2, 2D, 2E-1, and 2E-2 in employing stealth-type laser dicing in the process for cutting the silicon substrate 301 to form the recording element substrates 100 separated from each other. Accordingly, the manufacturing method includes dividing the silicon substrate 301 into a plurality of recording element substrates 100 at designated separation portions 501 after completing the formation of the discharge port formation member 311, without using the RIE to dig the portions corresponding to the grooves 305, in the process for forming the second liquid supply ports 307 illustrated in FIG. 4C-1. Using the laser dicing is effective in obliquely separating the end surface that is opposed to a neighboring recording element substrate 100.

Figure 5A:
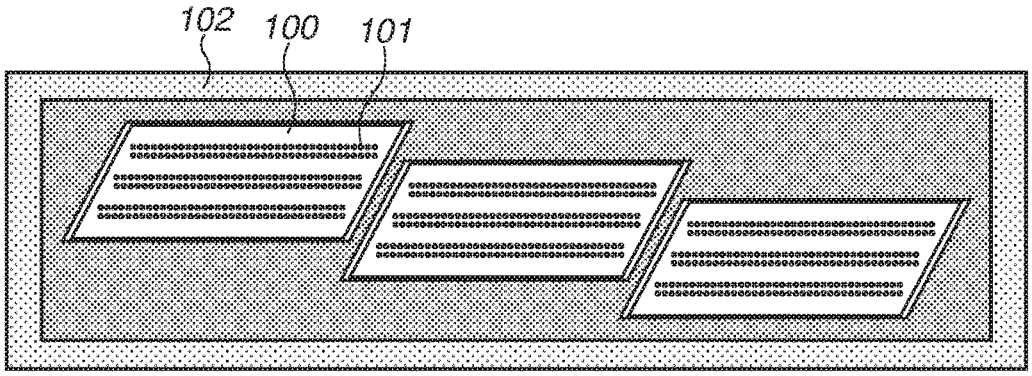
FIGS. 5A and 5B illustrate the configuration of a liquid discharge head according to a third exemplary embodiment of the present disclosure.
Figure 5B:
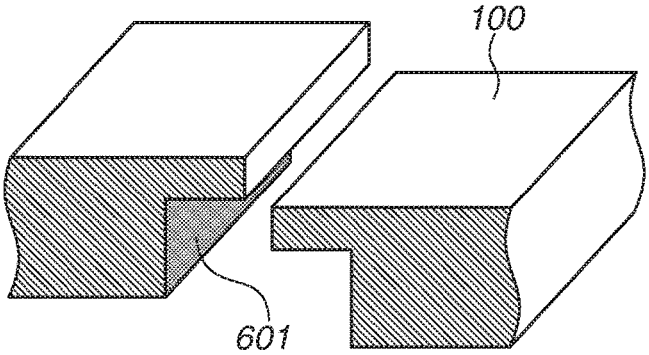

A third exemplary embodiment of the present disclosure will be described below. FIGS. 5A and 5B illustrate the configuration of a liquid discharge head according to the present exemplary embodiment. The present exemplary embodiment is different from the second exemplary embodiment in that a hydrophilic film 601 is formed on the surface (i.e., a wall surface) of the recessed portion 201. The hydrophilic film 601 is excellent in wettability compared to a silicon surface of the recording element substrate 100 on which the hydrophilic film 601 is not formed. For example, the hydrophilic film 601 can contain a metal oxide as a main component. Examples of the metal oxide include tantalum oxide, hafnium oxide, niobium oxide, titanium oxide, and zirconium oxide. The hydrophilic film 601 can contain a plurality of kinds of metal oxides.

Figure 6A:
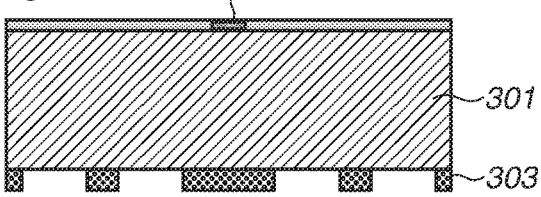
Figure 6B:
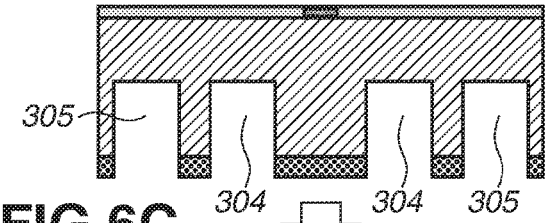
Figure 6C:
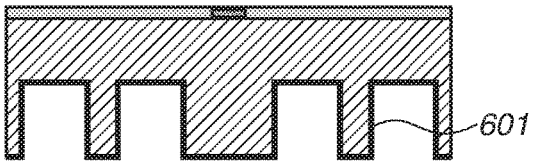
Figure 6D:
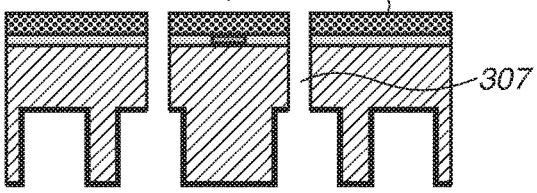
Figure 6E:
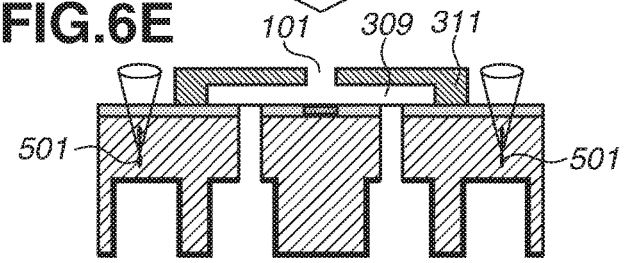
Figures 1, 6F:
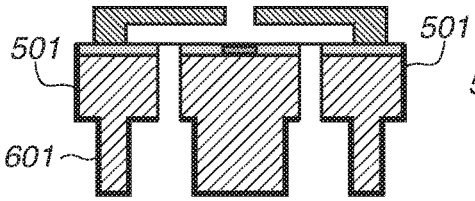
Figures 2, 6F:
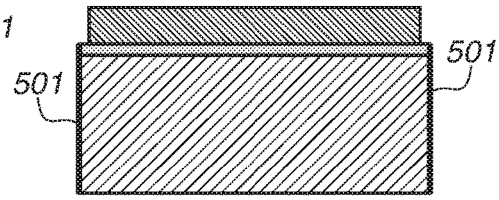

FIGS. 6A, 6B, 6C, 6D, 6E, 6F-1, and 6F-2 illustrate an exemplary method for manufacturing the liquid discharge head illustrated in FIGS. 5A and 5B. The method according to the present disclosure is different from the method according to the second exemplary embodiment in adding a film formation process which is performed after completing the first dicing process for forming the first liquid supply ports 304 and the grooves 305 and before starting the second dicing process for dividing the silicon substrate 301 to form the recording element substrates 100. More specifically, the film formation process includes forming the hydrophilic film 601, at least, at a part of the surface of the groove 305 where the recessed portion 201 is to be formed. For example, an exemplary method capable of realizing the film formation process is atomic layer deposition (ALD) method, thermal oxidation method, or plasma-enhanced chemical vapor deposition (plasma CVD) method. The manufacturing method includes forming the second liquid supply ports 307 as illustrated in FIG. 6D with the RIE after completing the film formation process, forming the discharge port formation member 311, and then performing the second dicing process. In the second dicing process, the stealth-type laser dicing can be employed to cut the silicon substrate 301 at the separation portions 501 to form the recording element substrates 100.

In the present exemplary embodiment, the hydrophilic film is formed on the inner surface of the recessed portion 201, as described above. As a result, the sealing member 103 can easily adhere to the inner surface of the recessed portion 201. Furthermore, the sealing member 103 can easily extend thinly along the inner surface of the recessed portion 201 while adhering to the inner surface. Thus, the sealing member 103 can smoothly flow into the recessed portion 201. Accordingly, it becomes feasible to stably inject the sealing member 103 into the intervening spaces between the recording element substrates 100.

Figures 1, 7A:
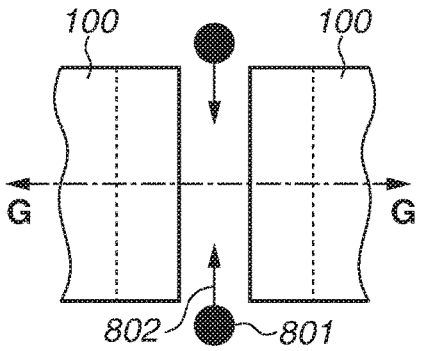
Figures 1, 7B:
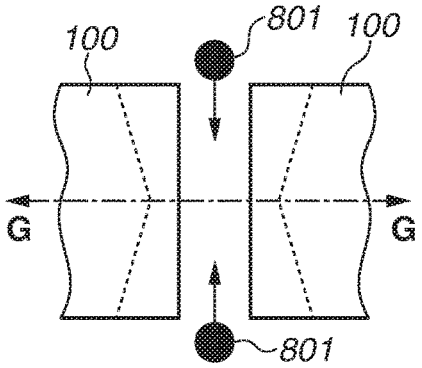
Figures 2, 7A:
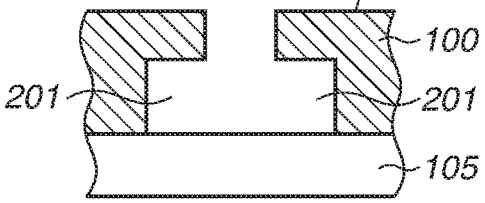
Figures 2, 7B:
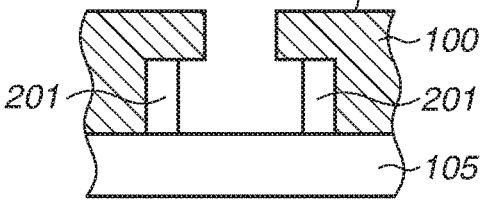

A fourth exemplary embodiment of the present disclosure will be described below. FIGS. 7B-1 and 7B-2 illustrate the configuration of a liquid discharge head according to the present exemplary embodiment. More specifically, FIG. 7B-1 is a transparent plan view illustrating an end portion of the recording element substrate 100 provided in the liquid discharge head according to the present exemplary embodiment of the present disclosure. FIG. 7B-2 is a cross-sectional view taken along a line G-G of FIG. 7B-1. The liquid discharge head according to the fourth exemplary embodiment is different from the liquid discharge head according to the first exemplary embodiment in the shape of the recessed portion 201 formed on the recording element substrate 100. FIG. 7A-1 is a transparent plan view illustrating the configuration of an end portion of the recording element substrate 100 provided in the liquid discharge head according to the first exemplary embodiment of the present disclosure. FIG. 7A-2 is a cross-sectional view taken along a line G-G of FIG. 7A-1. In the first exemplary embodiment, the gap between neighboring recording element substrates 100 is constant on the surface parallel to the element surface 202, in the recessed portion 201. To the contrary, in the fourth exemplary embodiment, the gap between neighboring recording element substrates 100 varies depending on the distance from a predetermined position on the surface parallel to the element surface 202. The predetermined position is, for example, a sealing member injection position 801, i.e., an end portion where the end surface on which the recessed portion 201 is provided intersects with another end surface. As the distance from the injection position 801 becomes longer, the gap between neighboring recording element substrates 100 becomes narrower. The liquid discharge head according to the fourth exemplary embodiment, includes two injection positions 801. The gap between neighboring recording element substrates 100 is narrower as the distance from the closer injection position 801 becomes longer. In this manner, the gap between neighboring recording element substrates 100 is wide around the injection position 801. However, the gap between neighboring recording element substrates 100 gradually becomes narrower as the injected sealing member moves in a flow direction 802. The configuration according to the present exemplary embodiment can stably fill the intervening spaces between the recording element substrates 100 with the sealing member. The shape of the recessed portion 201 in the surface parallel to the element surface 202 can be easily controlled by changing an opening pattern of the first etching mask layer 303 prepared to form the grooves 305 illustrated in FIG. 2B.

Figures 1, 7C:
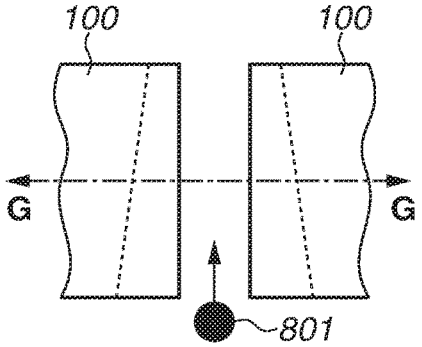

A fifth exemplary embodiment of the present disclosure will be described below. FIGS. 7C-1 and 7C-2 illustrate the configuration of a liquid discharge head according to a fifth exemplary embodiment of the present disclosure. More specifically, FIG. 7C-1 is a transparent plan view illustrating a configuration of an end portion of the recording element substrate 100 provided in the liquid discharge head according to the fifth exemplary embodiment of the present disclosure. FIG. 7C-2 is a cross-sectional view taken along a line G-G of FIG. 7C-1. The liquid discharge head according to the fifth exemplary embodiment different from the liquid discharge head described according to the first exemplary embodiment in the shape of the recessed portion 201 formed on the recording element substrate 100. In the fifth exemplary embodiment, the gap between neighboring recording element substrates 100 varies depending on the distance from one injection position 801. More specifically, the injection position 801 is the end portion where the end surface on which the recessed portion 201 is provided intersects with another end surface. The gap between neighboring recording element substrates 100 becomes narrower as the distance from the injection position 801 becomes longer. With this configuration, the sealing member can flow in one direction from one end portion of the recording element substrate 100. Therefore, the configuration according to the present exemplary embodiment can prevent bubbles from accumulating in the recessed portion 201 while the sealing member flows.

Figures 1, 7D:
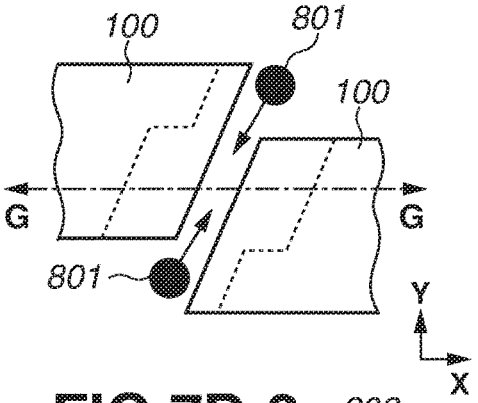
Figures 2, 7C:
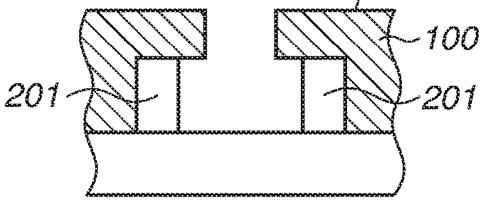
Figures 2, 7D:
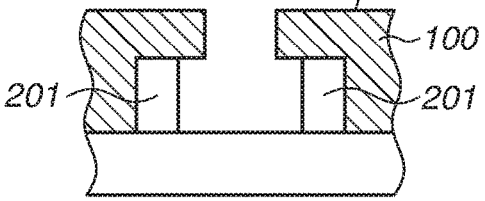
Figure 8A:
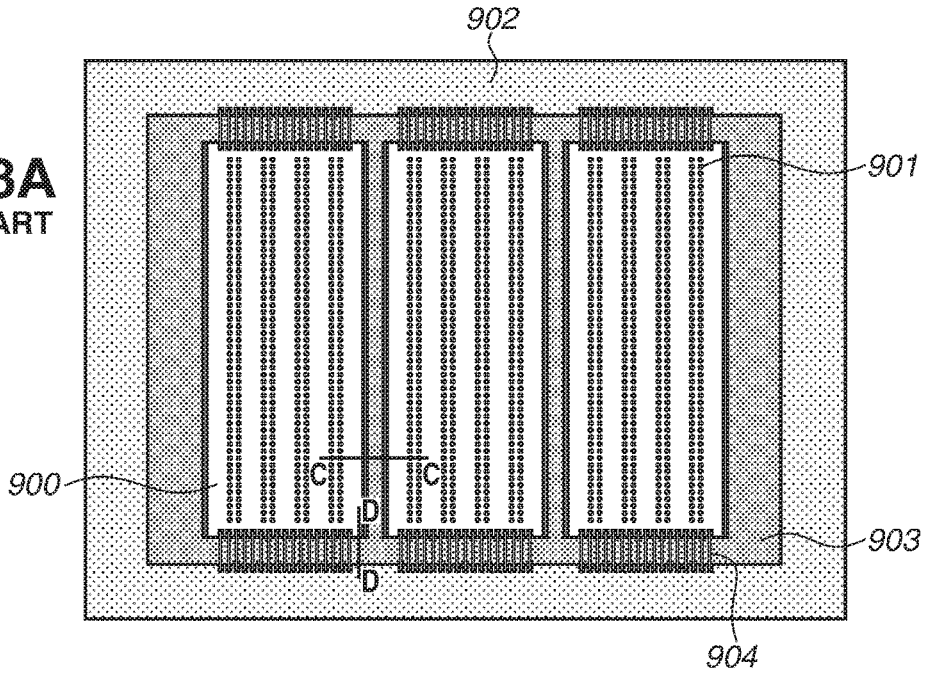
FIG.8A PRIOR ART
FIGS. 8A-8C illustrate the configuration of a liquid discharge head according to a comparable example of the present disclosure.
Figure 8B:
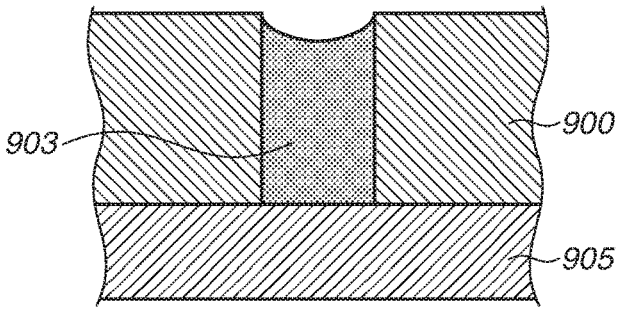
FIG.8B PRIOR ART
Figure 8C:
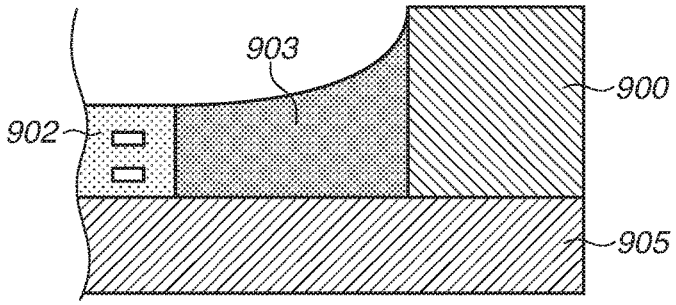
FIG.8C PRIOR ART

A sixth exemplary embodiment of the present disclosure will be described below. FIGS. 7D-1 and 7D-2 illustrate the configuration of a liquid discharge head according to the present exemplary embodiment of the present disclosure. More specifically, FIG. 7D-1 is a transparent plan view illustrating a configuration of an end portion of the recording element substrate 100 provided in the liquid discharge head according to the sixth exemplary embodiment of the present disclosure. FIG. 7D-2 is a cross-sectional view taken along a line G-G of FIG. 7D-1. The liquid discharge head according to the sixth exemplary embodiment is different from the liquid discharge head according to the second exemplary embodiment, in the shape of the recessed portion 201 formed on the recording element substrate 100. The liquid discharge head according to the present exemplary embodiment includes a plurality of recording element substrates 100 arranged out of alignment in the direction Y orthogonal to the direction X along which the discharge ports 101 are aligned, as illustrated in FIG. 3A. Accordingly, the recessed portion 201 of the recording element substrate U includes a region that faces a neighboring recording element substrate 100 and another region that does not face a neighboring recording element substrate 100. In the present exemplary embodiment, the width of the recessed portion 201 in the region that faces a neighboring recording element substrate 100 is wider than the width of the recessed portion 201 in the region that does not face a neighboring recording element substrate 100. Accordingly, the sealing member can be easily injected into the intervening spaces between respective recording element substrates 100.

Although the present disclosure has been descried with reference to some exemplary embodiments, the present disclosure is not limited to only the above-mentioned exemplary embodiments. The above-mentioned configurations and details can be changed or modified in various ways within the scope of the present disclosure when such a change or modification can be understood by a person skilled in the art.

For example, each recessed portion 201 is communicated with the back surface 203 of the element surface 202 in the above-mentioned exemplary embodiments. However, the present disclosure is not limited to the above-mentioned examples. For example, any other modified configuration will be employable as long as the opening for injecting the sealing member 103 into the intervening spaces extending between respective recording element substrates 100 is wider than the gap between the element surfaces 202 when seen from the side on which the electrical wiring substrate 102 is located, even if the back surface 203 is not communicated with the recessed portion 201.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-075686, filed Apr. 5, 2016, which is hereby incorporated by reference herein in its entirety.

What is claimed is:

1. A liquid discharge head comprising:

a plurality of recording element substrates each having an energy generating element configured to generate energy for discharging liquid from a discharge port; and a sealing member with which a surround of each of the plurality of recording element substrates is filled, wherein each of the plurality of recording element substrates includes a recessed portion on an end surface that faces a neighboring recording element substrate, and in the recessed portion, a gap between neighboring recording element substrates is wider than a gap between element surfaces on which the energy generating element is provided.

2. The liquid discharge head according to claim 1, wherein the recessed portion is opened at an end surface intersecting with the end surface on which the recessed portion is provided.

3. The liquid discharge head according to claim 1, wherein the recessed portion is communicated with a back surface of the element surface.

4. The liquid discharge head according to claim 1, wherein a hydrophilic film is formed at least at a part of the recessed portion.

5. The liquid discharge head according to claim 4, wherein the hydrophilic film has wettability higher than wettability on a surface of the recording element substrate.

6. The liquid discharge head according to claim 1, wherein the gap between neighboring recording element substrates is variable depending on a distance from a predetermined position on a surface parallel to the element surface.

7. The liquid discharge head according to claim 6, wherein the predetermined position is an end portion where the end surface on which the recessed portion is provided intersects with another end surface, and the gap between neighboring recording element substrates becomes narrower as the distance from the predetermined position becomes longer.

8. The liquid discharge head according to claim 6, wherein the predetermined position is two end portions where the end surface on which the recessed portion is provided intersects with another end surface, and the gap between neighboring recording element substrates becomes narrower as the distance from a closer one of the two end portions becomes longer.

9. The liquid discharge head according to claim 1, wherein the recessed portion includes a portion that faces a neighboring recording element substrate and a portion that does not face a neighboring recording element substrate, and on a surface parallel to the element surface, a width of the recessed portion at the portion that faces the neighboring recording element substrate is wider than a width of the recessed portion at the portion that does not face the neighboring recording element substrate.

10. A liquid discharge head comprising:

a plurality of recording element substrates each having an energy generating element configured to generate energy for discharging liquid from a discharge port; and a sealing member with which a surround of each of the plurality of recording element substrates is filled, wherein a gap, between neighboring recording element substrates, on a back surface of an element surface on which the energy generating element is provided is wider than a gap, between the neighboring recording element substrates, on the element surface.

* * * * *